US010464723B1

(12) United States Patent
Jones

(10) Patent No.: US 10,464,723 B1
(45) Date of Patent: Nov. 5, 2019

(54) BOTTLE CONTENTS IDENTIFICATION SYSTEM

(71) Applicant: Jennifer Jones, Boca Raton, FL (US)

(72) Inventor: Jennifer Jones, Boca Raton, FL (US)

( * ) Notice: Subject to any disclaimer, the term of this patent is extended or adjusted under 35 U.S.C. 154(b) by 0 days.

(21) Appl. No.: 15/829,978

(22) Filed: Dec. 3, 2017

Related U.S. Application Data

(63) Continuation-in-part of application No. 14/859,331, filed on Sep. 20, 2015, now Pat. No. 9,834,350.

(60) Provisional application No. 62/054,874, filed on Sep. 24, 2014.

(51) Int. Cl.
*B65D 51/24* (2006.01)
*G09F 3/02* (2006.01)
*B65D 41/02* (2006.01)

(52) U.S. Cl.
CPC ..... *B65D 51/245* (2013.01); *B65D 41/02* (2013.01); *G09F 3/02* (2013.01); *G09F 2003/0273* (2013.01)

(58) Field of Classification Search
CPC .. B65D 51/245; B65D 47/06; B65D 2203/00; B65D 41/02; G09F 23/00; G09F 3/00; G09F 2023/0025; G09F 23/0091; G09F 3/02; G09F 2003/0273
See application file for complete search history.

(56) References Cited

U.S. PATENT DOCUMENTS 1,557,332 A 10/1925 Robbins
1,905,927 A 4/1933 Marsh
2,101,565 A 12/1937 Snelling
2,248,011 A * 7/1941 Neuschaefer ..... A45D 34/045 132/317
2,318,434 A * 5/1943 Strauch ..... B65D 23/0857 206/821
3,037,310 A 6/1962 Montalto
3,370,733 A 2/1968 Giesler
3,841,513 A * 10/1974 O'Connor ..... B65D 50/067 215/204
4,373,632 A 2/1983 VanZandt
D296,081 S * 6/1988 Kuboshima ..... D9/443
5,289,650 A * 3/1994 Follett ..... G09F 3/04 206/499
5,362,561 A 11/1994 Lower
D369,550 S 5/1996 Crosby
7,055,680 B2 6/2006 Liebers
7,942,451 B2 5/2011 Adler
8,201,385 B2 6/2012 McLean
(Continued)

*Primary Examiner* — Cassandra Davis

(74) *Attorney, Agent, or Firm* — Allen D Hertz, P.A.; Allen D. Hertz

(57) ABSTRACT

An identification system for identifying contents within a bottle. The identification system introduces a label upon a sidewall of a cap of the bottle or as a billboard extending upward from a top surface of the cap. The location improves the visibility of the indicia located on the label easing the identification process when the bottles are placed behind one another, on a shelf above eye level or any other location where the view of the content identifying indicia can potentially be obstructed from view. The label can be wrapped about the cap sidewall, adhered to the cap sidewall or be designed to include an upright billboard extending from the cap top surface. The billboard variant can transform from a planar stored configuration to an upright display configuration.

20 Claims, 12 Drawing Sheets

(56) References Cited

U.S. PATENT DOCUMENTS

| | | | | |
|---|---|---|---|---|
| D682,098 | S * | 5/2013 | Murray | D9/443 |
| 8,434,652 | B2 * | 5/2013 | Rushe | B65D 41/0485 215/321 |
| 2004/0007548 | A1 * | 1/2004 | Tilly | A47B 77/16 211/74 |
| 2004/0205989 | A1 | 10/2004 | Michaels | |
| 2004/0216340 | A1 * | 11/2004 | Woods | B65D 51/245 40/311 |
| 2005/0109725 | A1 | 5/2005 | Stewart | |
| 2008/0237177 | A1 * | 10/2008 | Robinson | A61J 1/03 215/227 |
| 2009/0090688 | A1 | 4/2009 | Fruchter | |

* cited by examiner

BOTTLE CONTENTS IDENTIFICATION SYSTEM

CROSS-REFERENCE TO RELATED APPLICATION

This Non-Provisional Utility Patent Application is a Continuation-In-Part of U.S. Non-Provisional patent application Ser. No. 14/859,331 filed on Sep. 20, 2015 (scheduled to issue as U.S. Pat. No. 9,834,350 on Dec. 5, 2017), wherein U.S. Non-Provisional patent application Ser. No. 14/859,331 is a Non-Provisional Patent Application claiming the benefit of U.S. Provisional Patent Application Ser. No. 62/054,874 filed on Sep. 24, 2014, which is incorporated herein in its entirety.

FIELD OF THE INVENTION

The present invention relates to a spice bottle identification apparatus and method of use. More specifically, the spice bottle identification system employs an identifier that is provided in a form of a label, a billboard, or an elastic band, wherein each of the identifiers is secured to a cap of a spice bottle for ease of identification of contents of the spice bottle.

BACKGROUND OF THE INVENTION

Bottles are used for storing any of a variety of contents. Bottles can be stored in a variety of locations.

Spices are one example of an item that is commonly distributed and stored in bottles. Spices are derived from a dried seed, fruit, root, bark, or vegetable substance. Spices are primarily used for flavoring, coloring or preserving food. Spices are also used to hide other flavors.

Bottles containing spices are commonly stored in a pantry or upper cabinets of a kitchen. The spices are identified by a label that is adhesively attached to a sidewall of the bottle. The location of the label introduces a hardship to a person trying to locate a specific spice. Additionally, the sidewall of the bottles is normally the widest part of the bottle. When multiple spice bottles are stored adjacent to one another, the labels can be obscured hindering the process of identifying a specific spice. The labels may be rotated orienting the indicia away from the view of the individual. In a condition where the spice bottles are stored above eye level, the shelf can obscure a view of the labels from the individual. These and other factors impact the ability of the individual to locate one or more specific spices within a storage area.

It is understood that the same issues are associated with containers storing other items, compositions, and the like.

Accordingly, there remains a need in the art for a labeling system enabling visibility to an identifier of contents of a bottle when the bottle is located on an elevated supporting platform, such as a shelf.

SUMMARY OF THE INVENTION

The present invention overcomes the deficiencies of the known art by disclosing an apparatus and a method of use for identifying contents within a bottle, more specifically a spice, herb, or similar within a bottle.

In accordance with one embodiment of the present invention, the invention consists of a bottle contents identifying system comprising:

a bottle container;

a bottle cap removably attachable to the bottle in a manner to seal the bottle when closed and obtain access to contents within the bottle when removed;

a contents identification label; and indicia disposed upon a surface of the contents identification label, wherein the indicia identifies contents of the bottle;

wherein the contents identification label is attached to a sidewall of the cap of the bottle.

In a second aspect, the label is attached to the bottle cap using a bonding agent. The bonding agent can be an adhesive, glue, epoxy, double sided tape, and the like.

In another aspect, the label can be provided in a form of a continuous loop, wherein the continuous loop is sized for attachment to the sidewall of the cap of the bottle.

In another aspect, the label can be provided in a form of a continuous loop, wherein the continuous loop is sized for attachment to an upper region of the sidewall of the bottle.

In another aspect, the label can be provided in a form of a continuous loop, wherein the continuous loop is sized for attachment to a neck portion of the bottle.

In another aspect, the label can be provided in a form of a loop, wherein the loop is adjustable in size.

In yet another aspect, the label is fabricated of a material having elastic properties, such as rubber, elastic, and the like. The loop would be sized to employ the elastic properties to retain the label around a circumference of the sidewall of the cap of the bottle.

In yet another aspect, the indicia can be recessed within the material of the label.

In yet another aspect, the indicia can be formed as an embossing on the material of the label.

In yet another aspect, the indicia can be applied using a pliant ink or paint.

In accordance with a second embodiment of the present invention, the invention consists of a bottle contents identifying system comprising:

a bottle container;

a bottle cap removably attachable to the bottle in a manner to seal the bottle when closed and obtain access to contents within the bottle when removed; and a billboard identification assembly comprising:

an identifier base element, a billboard hingeably attached to the identifier base element, and indicia disposed upon at least one surface of the billboard, wherein the indicia identifies contents of the bottle, wherein the identifier base element is attached to a top surface of the cap of the bottle and the billboard is rotated into an orientation that is generally perpendicular to the top surface of the bottle.

In a second aspect, the billboard is retained in a generally perpendicular orientation by a support leg.

In another aspect, the support leg is hingeably attached to one side of the billboard.

In yet another aspect, the indicia is disposed upon both surfaces of the billboard.

In yet another aspect, the billboard identification assembly further comprises an adhesive applied to an attachment surface of the identifier base element.

In yet another aspect, a plurality of at least one of contents identification label and billboard identification assemblies, wherein the labels provide a series of indicia identifying a plurality of different spices, herbs, and/or other contents. The indicia would be representative of commonly available spices, herbs, and the like.

In accordance with a variant of the present invention, the invention consists of a bottle contents identifying system comprising:

a bottle container;

a bottle cap removably attachable to the bottle in a manner to seal the bottle when closed and obtain access to contents within the bottle when removed; and a bottle contents identification assembly comprising:

an identifier base element, the identifier base element having a peripheral edge, a contents identification wrap extending from the peripheral edge of the identifier base element, wherein a longitudinal axis of the contents identification wrap is substantially perpendicular to a radius between a centroid of the identifier base element and a point of intersection between the contents identification wrap and the peripheral edge of the identifier base element, and identification wrap indicia disposed upon an exterior surface of the contents identification wrap, wherein the identification wrap indicia identifies contents of the bottle, wherein the identifier base element is attached to a top surface of the cap of the bottle and the contents identification wrap is secured to a sidewall surface of the cap.

In a second aspect, the bottle contents identification assembly further comprises:

a billboard hingeably attached to the identifier base element; and billboard indicia disposed upon at least one surface of the billboard, wherein the billboard indicia identifies contents of the bottle, In another aspect, the contents identification wrap has a wrap length extending between a first longitudinal end and a second longitudinal end, wherein the wrap length is substantially equal to a circumferential length of the sidewall surface of the cap.

In yet another aspect, the contents identification wrap further comprises a first bonding section located at a first end and a second bonding section located at a second, opposite end.

In yet another aspect, the contents identification wrap includes an adhesive applied to an interior surface.

In yet another aspect, the contents identification wrap has a wrap length extending between like ends of the first bonding section and the second bonding section, wherein the wrap length is substantially equal to a circumferential length of the sidewall surface of the cap.

In yet another aspect, the bottle contents identification assembly contains two contents identification wraps, one contents identification wrap being located being located on an opposite quadrant of the identifier base element than the second contents identification wrap.

In yet another aspect, the bottle contents identification assembly contains two contents identification wraps; each of the contents identification wraps having a wrap length is substantially equal to half of the circumferential length of the sidewall surface of the cap.

In yet another aspect, the bottle contents identification assembly contains identification wrap indicia identifying the contents of the bottle in at least one location thereon.

In yet another aspect, the bottle contents identification assembly contains two contents identification wraps and the identification wrap indicia identifying the contents of the bottle in two locations thereon, one on each contents identification wrap.

In yet another aspect, the first bonding section and second bonding section comprise a mechanical fastener for joining the first bonding section and second bonding section to one another.

In yet another aspect, the first bonding section comprises an adhesive.

In a first method of identifying contents of a bottle, the method comprises steps of:

obtaining a bottle having contents therein, the bottle comprising:

a container, the container defining an interior volume for storing contents, and a bottle cap removably attachable to the container in a manner to seal the container when closed and obtain access to contents within the interior volume of the container when removed;

identifying contents within the interior volume of the container;

obtaining a contents identifier assembly, the contents identifier assembly comprising at least one of:

(a) a contents identification wrap adapted to be attached to a sidewall of the bottle cap, indicia applied to the contents identification wrap wherein the indicia identifies the contents of the interior volume of the bottle container, and (b) a contents identification billboard extending vertically from a contents identifier substrate, the contents identifier substrate being adapted to be attached to a top surface of the bottle cap, indicia applied to the contents identification billboard wherein the indicia identifies the contents of the interior volume of the bottle container; and joining the contents identifier assembly to the bottle cap, wherein the indicia is visible from a side elevation view of the bottle.

In a second aspect, the contents identifier assembly comprises the following:

(a) a contents identification billboard extending vertically from a contents identifier substrate, the contents identifier substrate being adapted to be attached to a top surface of the bottle cap, indicia applied to the contents identification billboard wherein the indicia identifies the contents of the interior volume of the bottle container;

(b) a contents identification wrap adapted to be attached to a sidewall of the bottle cap, indicia applied to the contents identification wrap wherein the indicia identifies the contents of the interior volume of the bottle container, and In another aspect, the contents identifier assembly comprises the contents identification wrap adapted to be attached to a sidewall of the bottle cap, the method further comprising a step of:

joining the contents identifier assembly to the sidewall of the bottle cap, wherein the indicia is visible from a side elevation view of the bottle.

In another aspect, the contents identifier assembly comprises the contents identification billboard extending vertically from the contents identifier substrate, the method further comprising a step of:

joining the contents identifier assembly to the top surface of the bottle cap, wherein the indicia is visible from a side elevation view of the bottle.

In yet another aspect, the contents identification billboard is rotationally assembled to the contents identifier substrate, the method further comprising a step of:

rotating the contents identification billboard from an orientation being substantially parallel to a surface of the contents identifier substrate to an orientation being substantially perpendicular to the surface of the contents identifier substrate.

In yet another aspect, the contents identifier assembly further comprising a contents identifier billboard support leg, the method further comprising a step of:

positioning the contents identifier billboard support leg contents to support the identification billboard in the orientation being substantially perpendicular to the surface of the contents identifier substrate.

In yet another aspect, the contents identification wrap is fabricated of an elastic material, the method further comprising steps of:

stretching the elastic material of the contents identifier assembly;

placing the stretched contents identifier assembly about a circumference of the sidewall of the bottle cap; and retaining the contents identifier assembly about a circumference of the sidewall of the bottle cap by properties of the elastic material.

In yet another aspect, the contents identifier assembly further comprising an adhesive applied to an adhesive section located proximate one end thereof, the method further comprising steps of:

exposing the adhesive applied to the adhesive section of the contents identifier assembly;

circumscribing the contents identifier assembly around the sidewall of the bottle cap;

bonding the adhesive to a second end of the contents identifier assembly; and retaining the contents identifier assembly to the sidewall of the bottle cap by friction.

In yet another aspect, the method further comprises a step of:

applying the indicia to at least one of the contents identification wrap and the contents identification billboard in accordance with at least one of:

pre-applied by a manufacturer, applied by adhering a label to the at least one of the contents identification wrap and the contents identification billboard, and manually writing the contents identification on the at least one of the contents identification wrap and the contents identification billboard.

In yet another variant of the present invention, the identifier billboard assembly is provided having:

a contents identifier billboard supporting base element having a base element upper surface and a base element attachment surface, the base element upper surface and the base element attachment surface being located on opposite sides of the contents identifier billboard supporting base element; and a contents identifier tab billboard comprising:

at least three contents identification segments, each contents identification segment extending generally perpendicularly upward from the base element upper surface, a contents identifier indicia displayed on each contents identification segment, the contents identifier indicia identifying contents of a container.

In a second aspect, the identifier billboard assembly is fabricated of a molded material.

In another aspect, the identifier billboard assembly is fabricated of a molded plastic.

In yet another aspect, the contents identifier tab billboard includes a hollowed interior.

In yet another aspect, the contents identifier tab billboard includes a tapered hollow interior and a tapered exterior surface, wherein the tapered exterior surface is sized and shaped to nest within the tapered hollow interior.

In yet another aspect, each contents identification segment of the at least three contents identification segments has an inwardly arched indicia displaying surface.

In yet another aspect, the contents identifier tab billboard includes three contents identification segments arranged forming a generally triangular configuration.

In yet another aspect, the contents identifier tab billboard includes three contents identification segments of equal size and shape, the three contents identification segments are arranged forming a triangular configuration.

In yet another aspect, each contents identification segment of the at least three contents identification segments has a planar indicia displaying surface.

In yet another aspect, the identifier billboard assembly further comprises adhesive applied to the base element attachment surface.

In yet another aspect, the adhesive applied to the base element attachment surface is covered with a removable protective cover.

In yet another aspect, the identifier billboard assembly is included with other like shaped identifier billboard assemblies providing a kit, each identifier billboard assembly displaying a unique contents identifier indicia identifying different contents.

In yet another aspect, the identifier billboard assembly is included with other like shaped identifier billboard assemblies, each identifier billboard assembly displaying a unique contents identifier indicia identifying different spices.

In yet another aspect, the contents identifier indicia displayed on each contents identification segment, the contents identifier indicia identifying contents of a container, wherein the contents is a spice.

In yet another aspect, wherein the contents identifier billboard supporting base element is a bottle cap.

In yet another variant of the present invention, the identifier billboard assembly is provided having:

a base material shaped to include:

at least three contents identification segments, each contents identification segment being located adjacent to another and in alignment along a longitudinal axis, at least three billboard attachment surfaces, each billboard attachment surface extending inward from a respective contents identification segment, wherein lateral edges of each billboard attachment surface being shaped to avoid overlap of an adjacent billboard attachment surface when assembled to a bottle cap, a billboard bonding section adapted to join opposite distal longitudinal ends of the base material to one another when the base material is shaped into a configuration for use; and a contents identifier indicia displayed on each contents identification segment.

In a second aspect, each of the at least three contents identification segments are of the same longitudinal length.

In another aspect, each billboard attachment surface has a trapezoidal shape, more specifically an isosceles trapezoid shape.

In yet another aspect, a billboard attachment surface adhesive is applied to each billboard attachment surface.

In yet another aspect, the billboard attachment surface adhesive is applied to a viewing side of each billboard attachment surface.

In yet another aspect, the billboard attachment surface is covered with a removable billboard attachment surface adhesive protective cover.

In yet another aspect, the billboard bonding section employs an adhesive for joining the opposite distal longitudinal ends of the base material to one another.

In yet another aspect, the base material is shaped including three contents identification segments.

In yet another aspect, the three contents identification segments are of the same longitudinal length.

In yet another aspect, the billboard attachment surfaces are of the same shape and size.

In yet another aspect, the identifier billboard assembly further comprises a base element; the identifier billboard assembly being affixed to an upper surface of the base element, the base element is configured to be attached to the bottle cap.

In yet another aspect, the identifier billboard assembly being affixed to the bottle cap.

In yet another aspect, the identifier billboard assembly being affixed to an upper surface of the bottle cap.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Figure 1:
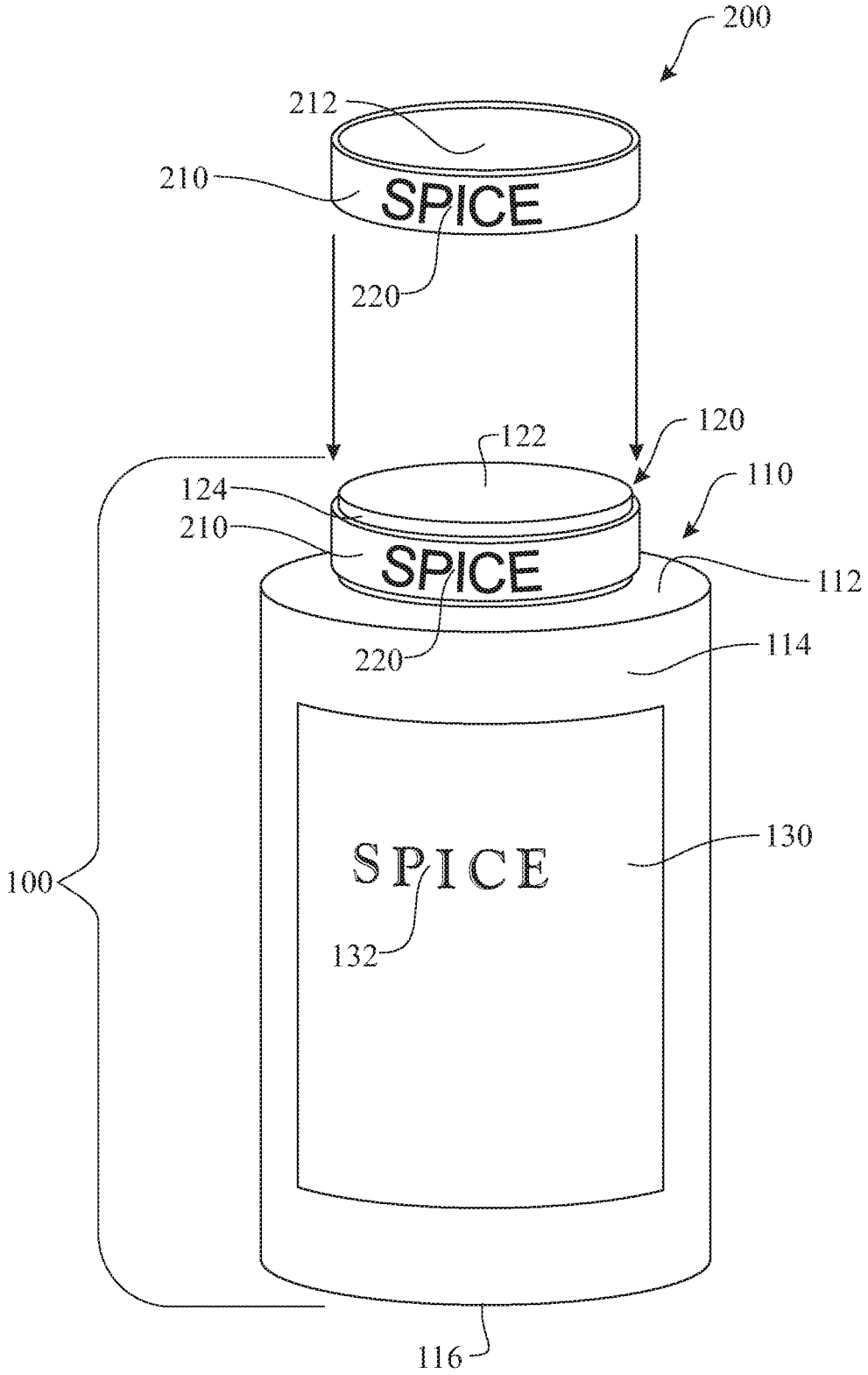
FIG. 1 presents an isometric view of a first exemplary bottle content identification label being attached to an exemplary cap of an exemplary bottle, wherein the first exemplary bottle content identification label is fabricated in a form factor of a loop.

For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Bottles are used to hold and distribute fluids and bulk volumes of small items, such as fluids, spices, herbs, and many other similar items. Bottles 100 are manufactured in a multitude of shapes and sizes, with the most common shape having a cylindrically shaped sidewall 114, a planar or slightly concave bottom wall 116 and a threaded neck extending upward from a bottle top surface 112 for receiving a bottle cap 120, as shown in the exemplary embodiments presented in FIGS. 1, 2, and 4. Contents are deposited within an interior volume of the bottle 110. The bottle 110 is sealed by rotationally securing the bottle cap 120 to the threaded neck of the bottle top surface 112. The bottle cap 120 includes a bottle cap sidewall 124 extending downward from a circumferential edge of a bottle cap top surface 122. Threading is formed on an interior surface of the bottle cap sidewall 124. An exterior surface of the bottle cap sidewall 124 can include one or more features to enhance a grip to the user to aid in sealing and removal of the bottle cap 120 to and from the bottle 110. Examples of the grip enhancing features include texturing, knurling, ribbing, a non-circular shape, and the like.

Contents of the spice bottle assembly 100 are identified by spice identifier indicia 132 applied to a bottle label 130. The bottle label 130 is adhered to an exterior surface of the bottle sidewall 114 of the bottle 110. There are many circumstances where the spice identifier indicia 132 may not be readable by an individual. The spice identifier indicia 132 may be rotated away from a viewing orientation. The spice identifier indicia 132 may be concealed by another spice bottle assembly 100. The spice bottle assembly 100 may be placed upon a shelf located above eye level of the individual, wherein the shelf would block the view of the spice identifier indicia 132.

A spice identifier loop 200, shown in FIG. 1, introduces a first solution for enhancing labeling of the spice bottle assembly 100. The exemplary spice identifier loop 200 is fabricated in a circular shape, having a spice identifier loop exterior surface 210 and a spice identifier loop interior surface 212. The peripheral length of the spice identifier loop interior surface 212 would be the same or slightly shorter than a peripheral length surrounding the exterior surface of the bottle cap sidewall 124. The spice identifier loop 200 can be fabricated of any suitable material. In one variant, the spice identifier loop 200 can be manufactured of a flexible, non-stretch material, such as paper, cardboard, flexible plastic, and the like. In this variant, the peripheral length of the spice identifier loop interior surface 212 would be the same as the peripheral length surrounding the exterior surface of the bottle cap sidewall 124. The spice identifier loop 200 would be adhered to the bottle cap sidewall 124. In a second variant, the spice identifier loop 200 can be manufactured of a flexible material having elastic properties, such as rubber, silicone, and the like. In this variant, the peripheral length of the spice identifier loop interior surface 212 would be slightly shorter as the peripheral length surrounding the exterior surface of the bottle cap sidewall 124. The spice identifier loop 200 would be stretched and the difference in sizes would retain the spice identifier loop 200 upon the bottle cap sidewall 124. A spice identifier indicia 220 would be provided upon the spice identifier loop exterior surface 210. The spice identifier indicia 220 can be provided upon the spice identifier loop exterior surface 210 using any of a variety of the methods. One exemplary process would be by providing a recess extending inward from the spice identifier loop exterior surface 210. A second exemplary process would be by providing a boss extending outward from the spice identifier loop exterior surface 210. A third exemplary process would be by printing an image upon the spice identifier loop exterior surface 210. Although the spice identifier indicia 220 is shown as a single identifier, it is understood that multiple copies of the spice identifier indicia 220 can be spatially provided about the spice identifier loop exterior surface 210 of the spice identifier loop 200. The spice identifier indicia 220 can be applied to the spice identifier loop exterior surface 210 in accordance to at least one of: (a) pre-applied by a manufacturer; (b) applied by adhering a label to the at least one of the contents identification wrap and the contents identification billboard; (c) manually writing the contents identification on the at least one of the contents identification wrap and the contents identification billboard; or any other suitable method.

Although FIG. 1 illustrates a configuration where the spice identifier loop 200 is placed about the bottle cap sidewall 124, it is understood that the spice identifier loop 200 can be placed about an upper region of the bottle sidewall 114, surrounding a neck of the bottle 110, or any other suitable location of the spice bottle assembly 100.

Figure 2:
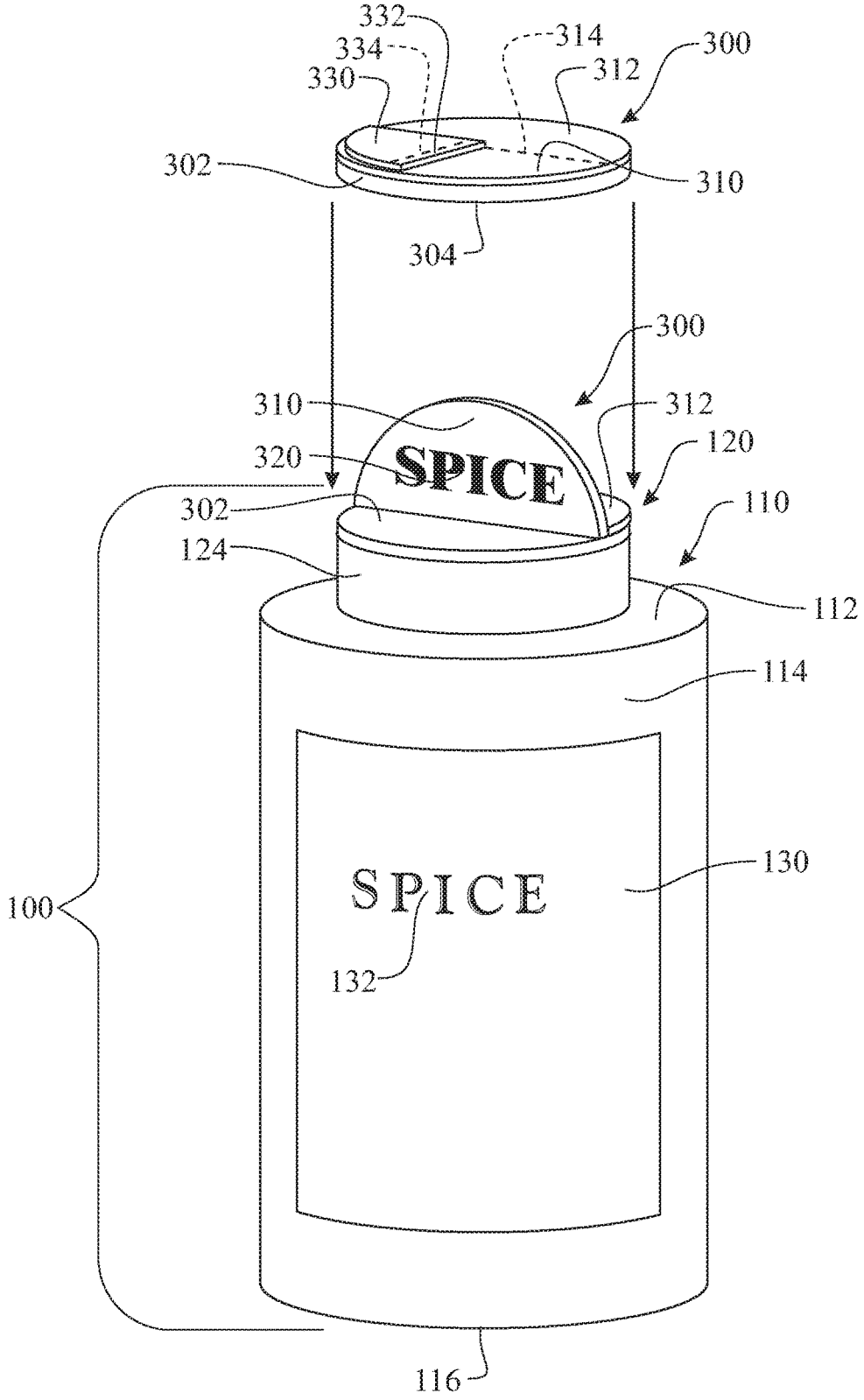
FIG. 2 presents an isometric view of a second exemplary bottle content identification label being attached to an exemplary cap of an exemplary bottle, wherein the second exemplary bottle content identification label is fabricated in a form factor of a billboard.
Figure 3A:
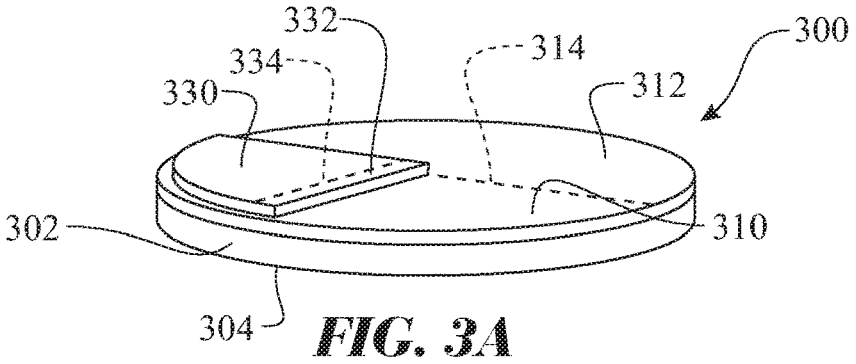
FIG. 3A presents an isometric view of the second exemplary bottle content identification label introduced in FIG. 2, wherein the second exemplary bottle content identification label is shown in a collapsed configuration.
Figure 3B:
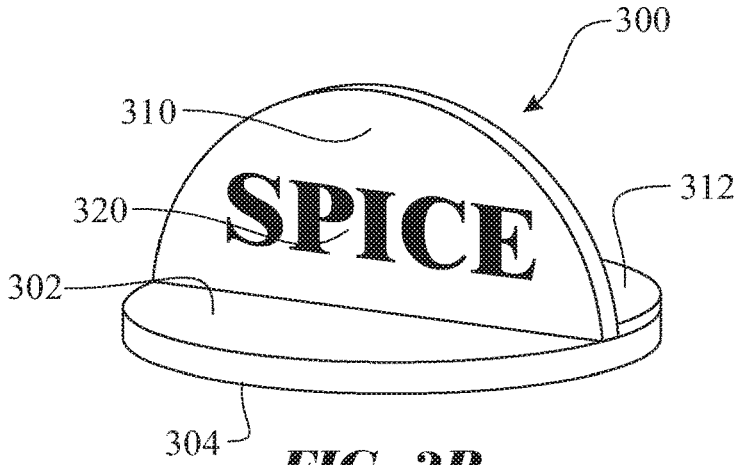
FIG. 3B presents an isometric view of the second exemplary bottle content identification label introduced in FIG. 2, wherein the second exemplary bottle content identification label is shown in a deployed configuration.
Figure 3C:
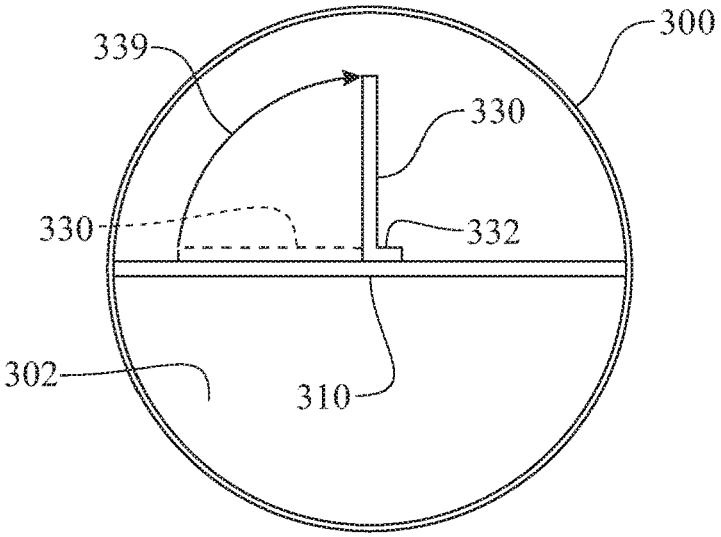
FIG. 3C presents a top plan view of the second exemplary bottle content identification label introduced in FIG. 2, wherein the second exemplary bottle content identification label is shown in a deployed configuration.

A spice identifier tab assembly 300, introduced in FIG. 2 and detailed in FIGS. 3A, 3B, and 3C, introduces a second solution for enhancing labeling of the spice bottle assembly 100. The exemplary spice identifier tab assembly 300 includes a spice identifier tab billboard base segment 312 adhered to an exposed surface of a spice identifier tab substrate 302. An adhesive is attached to a substrate adhesive surface 304 of the spice identifier tab substrate 302 for adhering the spice identifier tab assembly 300 to the bottle cap top surface 122 of the bottle cap 120. A spice identifier indicia 320 is provided on one or both sides of the spice identifier tab billboard 310. The spice identifier indicia 320 can be applied by the manufacturer, or the spice identifier indicia 320 can be provided as a series of labels included in a kit, whereby the user would select the appropriate label and adhere the selected label upon one or both surfaces of the spice identifier tab billboard 310. A spice identifier tab billboard 310 is foldably or hingeably integrated with the spice identifier tab billboard base segment 312; folding along a spice identifier tab billboard fold crease 314. The spice identifier tab billboard 310 and spice identifier tab billboard base segment 312 can be fabricated of a single, unitary material, such as a plastic, a paper based material, a foam based material, and the like. The spice identifier tab billboard fold crease 314 can be defined by an adhesive applied between the spice identifier tab billboard base segment 312 and the upper surface of the spice identifier tab substrate 302. The combination of the spice identifier tab billboard 310 and the spice identifier tab billboard base segment 312 can be manufactured of a material having plastic bending properties, wherein the spice identifier tab billboard 310 would remain in an upright position when bent along the spice identifier tab billboard fold crease 314. An optional spice identifier tab billboard support leg 330 can be integrated into the spice identifier tab assembly 300, wherein the spice identifier tab billboard support leg 330 supports the spice identifier tab billboard 310 in an upright position or billboard configuration. The spice identifier tab billboard support leg 330 is foldably or hingeably integrated with a billboard support leg attachment tab 332; folding along a billboard support leg fold crease 334. The billboard support leg attachment tab 332 can be joined to either the spice identifier tab billboard 310 (as shown) or the spice identifier tab billboard base segment 312. There are several advantages to the configuration where the billboard support leg attachment tab 332 is adhered to the spice identifier tab billboard base segment 312. The application of the spice identifier indicia 320 to the backside of the spice identifier tab billboard 310 is easier. This configuration enables adhesion of a label comprising the spice identifier indicia 320 to the backside of the spice identifier tab billboard 310.

The spice identifier tab billboard support leg 330 and billboard support leg attachment tab 332 combination can be manufactured of a material having plastic bending properties, wherein the spice identifier tab billboard support leg 330 would remain in an outstanding position when bent along the billboard support leg fold crease 334.

The spice identifier tab assembly 300 would be provided as a series, each spice identifier tab assembly 300 preferably having a different spice identifier indicia 320, identifying a different composition stored within the spice bottle assembly 100. The spice identifier tab assembly 300 would be stored in a collapsed or planar configuration, as shown in FIG. 3*a*, to reduce space. In use, the user would select the appropriate spice identifier tab assembly 300 having a spice identifier indicia 320 that properly identifies the contents within the spice bottle assembly 100. The user spice identifier tab substrate 302 would adhere the bottle cap top surface 122 of the bottle cap 120 to the substrate adhesive surface 304 using the adhesive applied upon the substrate adhesive surface 304. The user would then bend or rotate the spice identifier tab billboard 310 from a horizontal, planar or stored configuration into an upright, billboard configuration, as best shown in FIG. 3B. If included, the user would then bend or rotate the spice identifier tab billboard support leg 330 into a supporting configuration, wherein the spice identifier tab billboard support leg 330 extends between the spice identifier tab billboard 310 and the spice identifier tab billboard base segment 312, as best shown in FIG. 3C.

Figure 4:
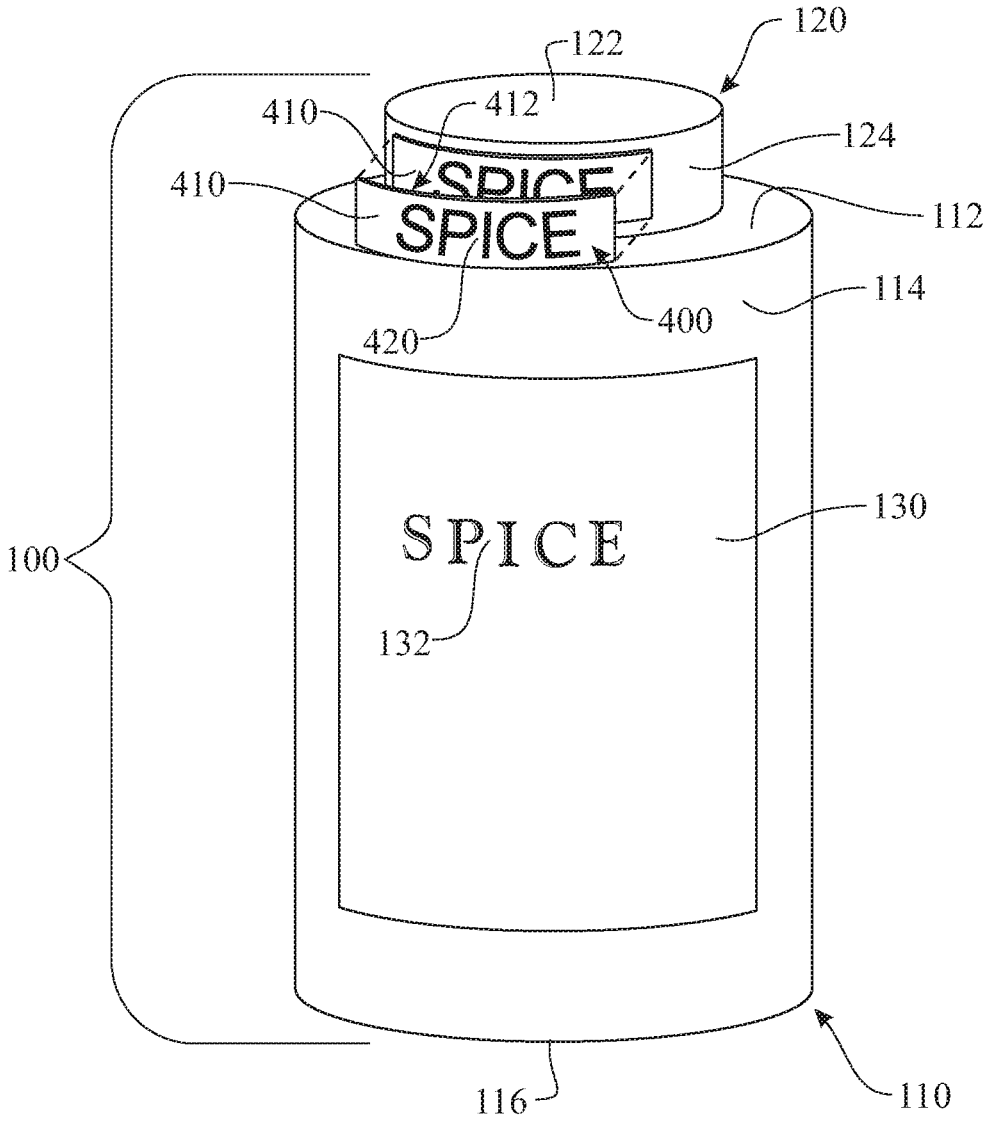
FIG. 4 presents an isometric view of a third exemplary bottle content identification label being attached to an exemplary cap of an exemplary bottle, wherein the third exemplary bottle content identification label is fabricated in a form factor of an adhesively attached label.

A spice identifier label 400, shown in FIG. 4, introduces a third exemplary solution for enhancing labeling of the spice bottle assembly 100. The exemplary spice identifier label 400 is fabricated in a rectangular shape, having a spice identifier label substrate 410 and a label adhesive surface 412. A spice identifier indicia 420 is provided upon the spice identifier label substrate 410. An adhesive or other bonding agent is applied to the label adhesive surface 412. In use, the individual would locate the spice identifier label 400 having the desired spice identifier indicia 420 provided thereon. Once identified, the individual would adhere the spice identifier label 400 to the bottle cap sidewall 124 of the bottle cap 120. It is understood that the spice identifier tab assembly 300 can include a plurality of spice identifier indicia 420 in a spatial arrangement. The inclusion of the plurality of spice identifier indicia 420 reduces an impact of orientation of the spice bottle assembly 100 when stored. The spice identifier label 400 can be cut to a desired length. It is noted that the spice identifier label 400 can be combined with the spice identifier loop 200 and spice identifier tab assembly 300 described above, wherein the spice identifier label 400 would be used as the label replacing the spice identifier indicia 220 and spice identifier indicia 320 respectively.

Figure 5:
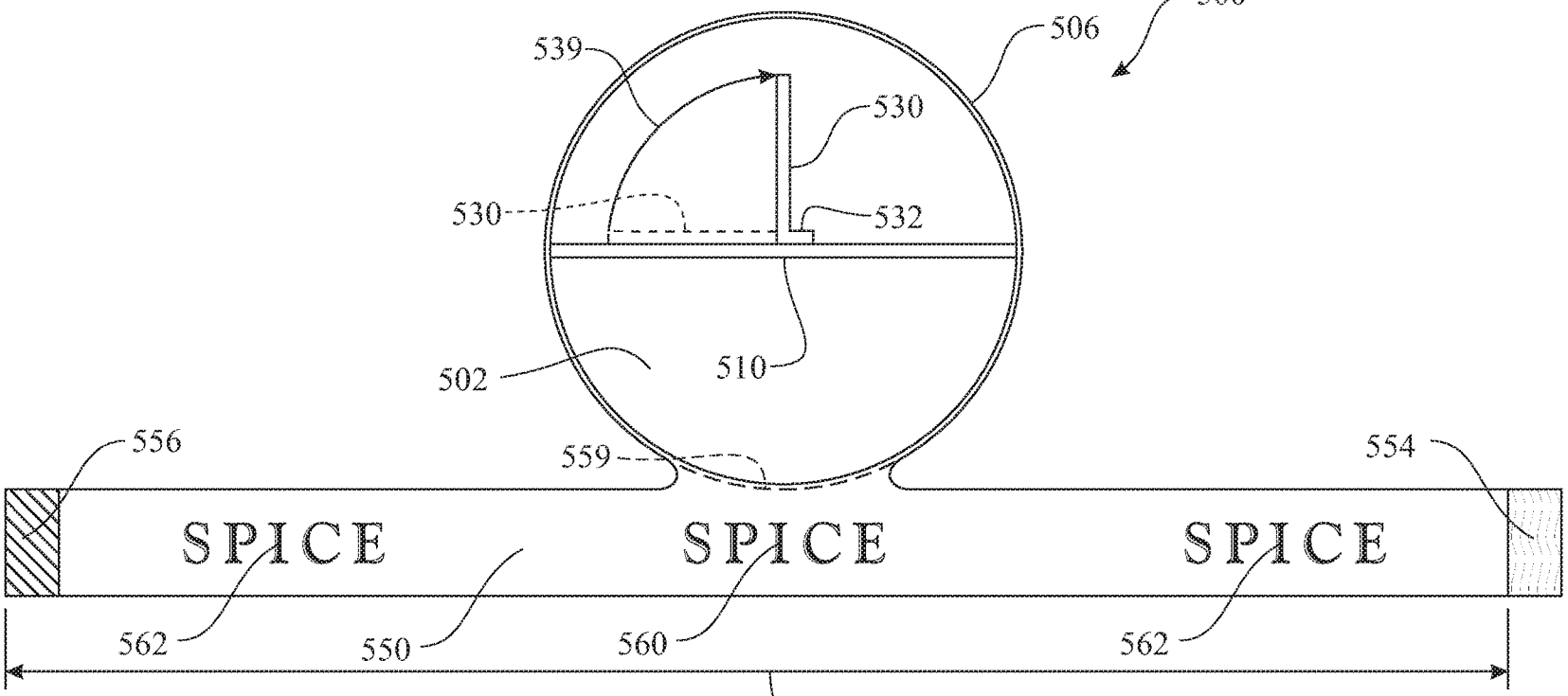
FIG. 5 presents a top plan view of a fourth exemplary bottle content identification system, wherein the fourth exemplary bottle content identification system provides a viewing solution similar to a combination of the first exemplary solution of FIG. 1 and the second exemplary solution of FIGS. 2 and 3.
Figure 6:
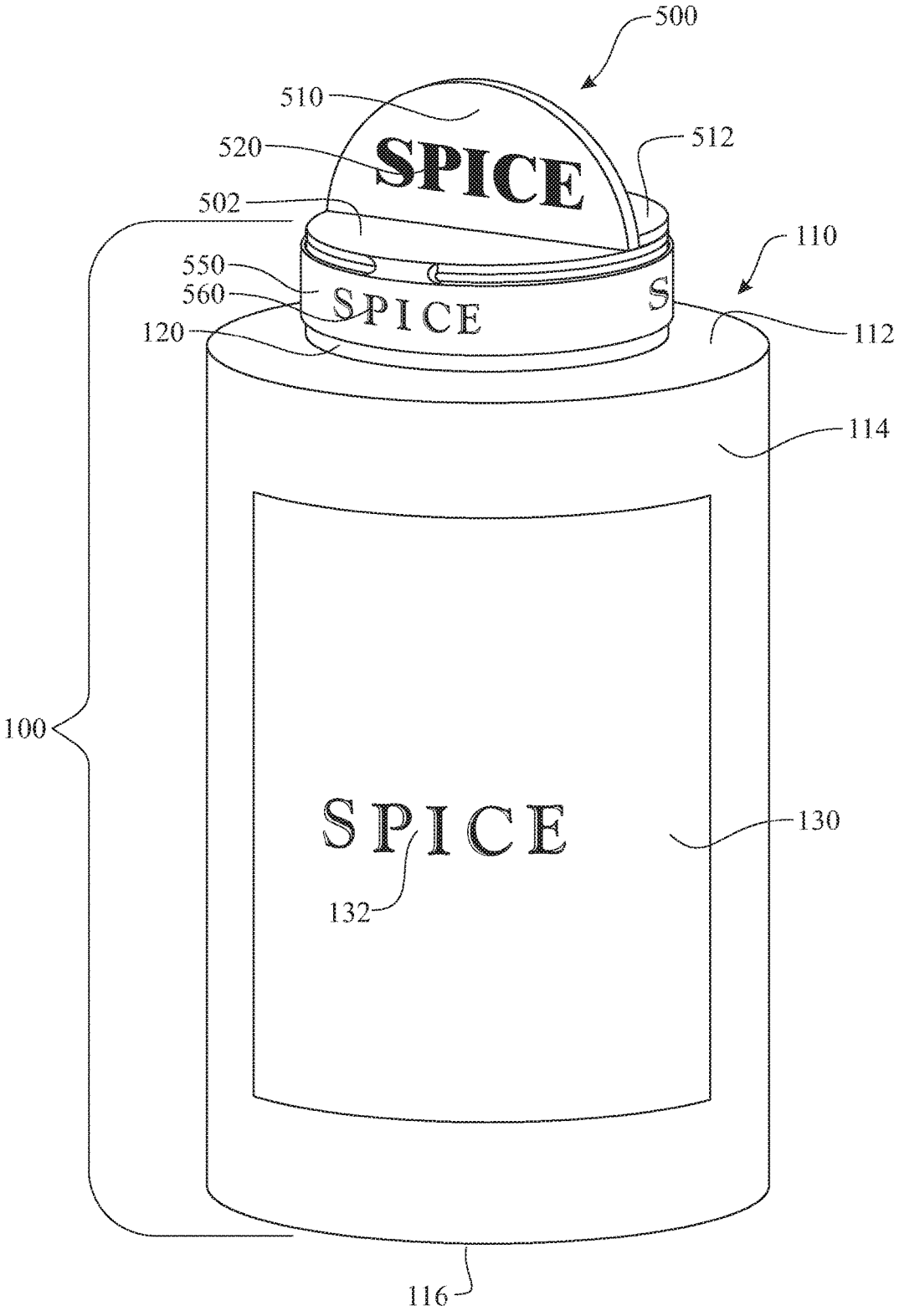
FIG. 6 presents an isometric view of the fourth exemplary bottle content identification system introduced in FIG. 5, wherein the fourth exemplary bottle content identification system is shown in a deployed configuration.

A spice identifier label 500, shown in FIGS. 5 and 6, introduces a fourth exemplary solution for enhancing labeling of the spice bottle assembly 100. The spice identifier tab assembly 500 is an enhanced variant of the spice identifier tab assembly 300, having a number of like elements. Like features of the spice identifier tab assembly 500 and the spice identifier tab assembly 300 are numbered the same except preceded by the numeral '5'. The spice identifier tab assembly 500 can be described as being segmented into two identification features: (a) a spice identifier tab billboard 510 and (b) a contents identification wrap 550. It is understood that the spice identifier tab assembly 500 exclusive of the contents identification wrap 550 is the spice identifier tab assembly 300. It is also understood that the spice identifier tab assembly 500 can be fabricated exclusive of the spice identifier tab billboard 510 and the associated elements thereof.

The contents identification wrap 550 can be an elongated rectangular shaped flexible material joined to the spice identifier tab substrate 502 at a quadrant of a spice identifier tab substrate circumferential edge 506 thereof. A longitudinal direction of the contents identification wrap 550 would be substantially perpendicular to a radial line extending between a centroid of the spice identifier tab substrate 502 and a centralized joint between the contents identification wrap 550 and the spice identifier tab substrate 502. A contents identification wrap circumferential length 552 of the contents identification wrap 550 would be substantially equal to a circumferential length of a spice identifier tab substrate circumferential edge 506 of the spice identifier tab substrate 502.

The contents identification wrap 550 can be secured to the sidewall 124 of the bottle cap 120 using any suitable implementation. In a first implementation, an adhesive can be applied to an interior surface of the contents identification wrap 550. In the first implementation, an overall longitudinal length of the contents identification wrap 550 can be equal to the contents identification wrap circumferential length 552. In a second implementation (as shown), an adhesive can be applied to a first bonding section 554. The first bonding section 554 can have a span that is generally equal to a span of a second bonding section 556 of the contents identification wrap 550. In the second implementation, the overall longitudinal length of the contents identification wrap 550 would be longer than the contents identification wrap circumferential length 552. The contents identification wrap circumferential length 552 can span between an interior edge of the first bonding section 554 and an exterior edge of the second bonding section 556. This configuration results in a circumferential length of the contents identification wrap 550 when the first bonding section 554 and the second bonding section 556 are joined to one another.

A centrally located indicia 560 is applied to an exterior surface of the contents identification wrap 550. It is understood that the contents identification wrap 550 can include one, two, three, or more of the centrally located indicia 560. The exemplary embodiment includes one centrally located indicia 560 and a pair of distally located indicia 562; the indicia 560, 562 are preferably equally spaced from one another when the first bonding section 554 and the second bonding section 556 are joined to one another.

An optional contents identification wrap separation feature 559 can be formed through the material of the spice identifier tab assembly 500, the optional contents identification wrap separation feature 559 being provided between the spice identifier tab substrate 502 and the contents identification wrap 550. The optional contents identification wrap separation feature 559 can aid the user in separating the contents identification wrap 550 from the spice identifier tab substrate 502. This feature enables the user to use the spice identifier tab substrate 502, the contents identification wrap 550, or both. This also allows the user to apply the contents identification wrap 550 to the sidewall 124 of the bottle cap 120 at any suitable location along an axial length thereof.

The contents identification wrap 550 can be secured to the sidewall 124 of the bottle cap 120 using any suitable attachment implementation. The spice identifier tab substrate 502 would be adhered to an upper surface of the bottle cap 120. The contents identification wrap 550 would be secured to the sidewall 124 of the bottle cap 120. In a first implementation, an adhesive can be applied to an interior surface of the contents identification wrap 550. The contents identification wrap 550 would be wrapped around the sidewall 124 of the bottle cap 120 and secured in position by the adhesive. In a second implementation, the contents identification wrap 550 would be wrapped about the circumference of the bottle cap 120. The two ends 554, 556 would be joined together using any suitable joining technique, such as adhesive. The two ends 554, 556 would be located respective to one another tightening the contents identification wrap circumferential length 552 of the contents identification wrap 550 about the circumference of the sidewall 124 of the bottle cap 120.

In a modified version of the spice identifier tab assembly 500, the spice identifier tab billboard 510 and the spice identifier tab billboard base segment 512 can be fabricated of a plastic or metal material. The plastic or metal material would bend in accordance with the plastic properties of the plastic or metal material, thus retaining the bent shape when bent into a desired configuration. The use of a material with plastic deforming properties enables the spice identifier tab assembly 500 to function as desired while excluding the spice identifier tab billboard support leg 530. The spice identifier tab billboard base segment 512 would be bonded to the spice identifier tab substrate 502. The spice identifier tab billboard 510 would bend upwards when desired and the plastic deforming properties of the material retains the spice identifier tab billboard 510 in an upright position.

Figure 7:
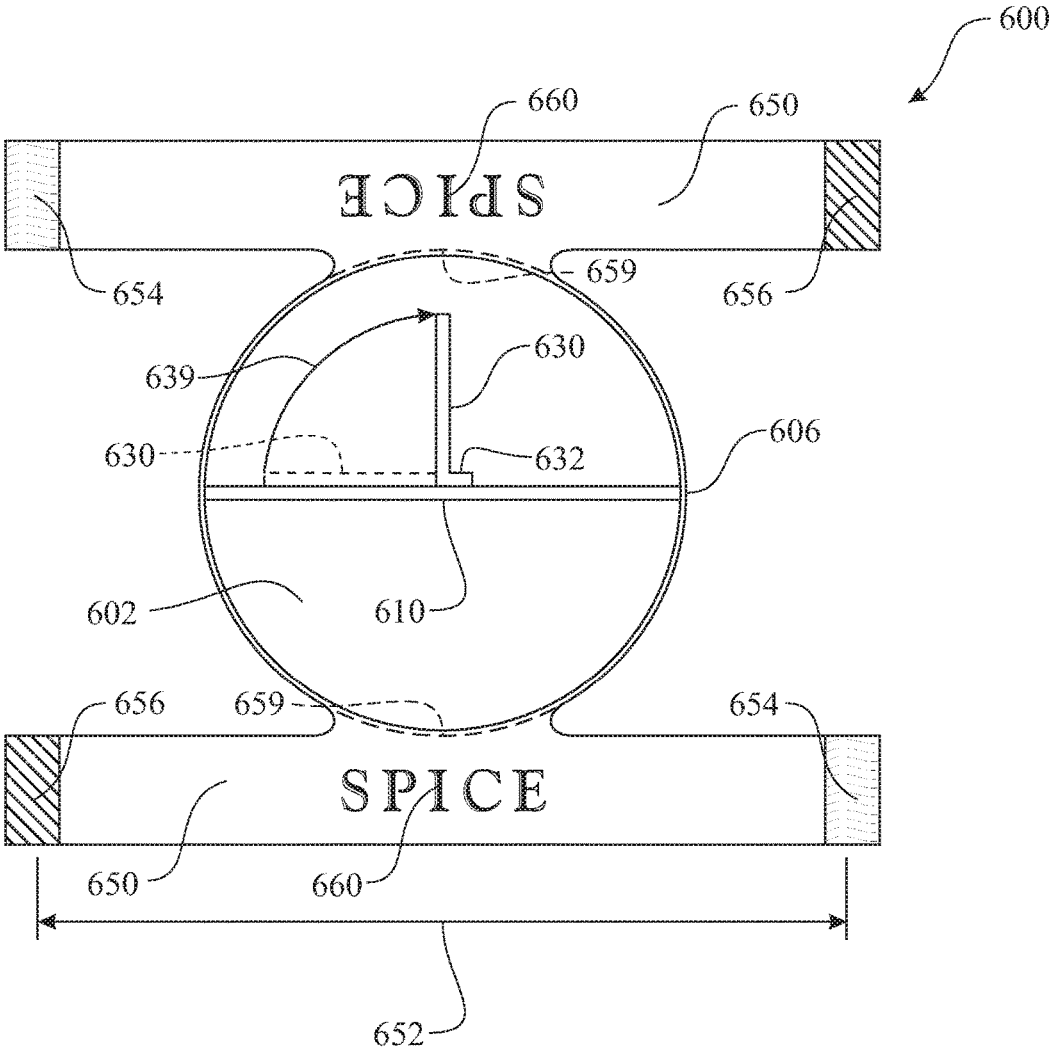
FIG. 7 presents a top plan view of a variant of the fourth exemplary bottle content identification system introduced in FIG. 5.

A spice identifier label 600, shown in FIG. 7, introduces a variant of the fourth exemplary solution for enhancing labeling of the spice bottle assembly 100. The spice identifier tab assembly 600 and the spice identifier tab assembly 500 have a number of like elements. Like features of the spice identifier tab assembly 600 and the spice identifier tab assembly 500 are numbered the same except preceded by the numeral '6'. The distinction between the spice identifier tab assembly 500 and the spice identifier tab assembly 600 is that the spice identifier tab assembly 600 includes a pair of contents identification wrap 650, whereas the spice identifier tab assembly 500 only includes on contents identification wrap 550. A first contents identification wrap 650 and a second contents identification wrap 650 would be arranged being mirror images of one another. A contents identification wrap circumferential length 652 would be one-half of a circumference of the spice identifier tab substrate circumferential edge 606. In one configuration, when installed, a first bonding section 654 of the one of the contents identification wraps 650 would be joined to a second bonding section 656 of the other of the contents identification wraps 650 and a second bonding section 656 of the one of the contents identification wraps 650 would be joined to a first bonding section 654 of the other of the contents identification wraps 650, forming a circumference substantially equal to the circumference of the spice identifier tab substrate circumferential edge 606.

Figure 8:
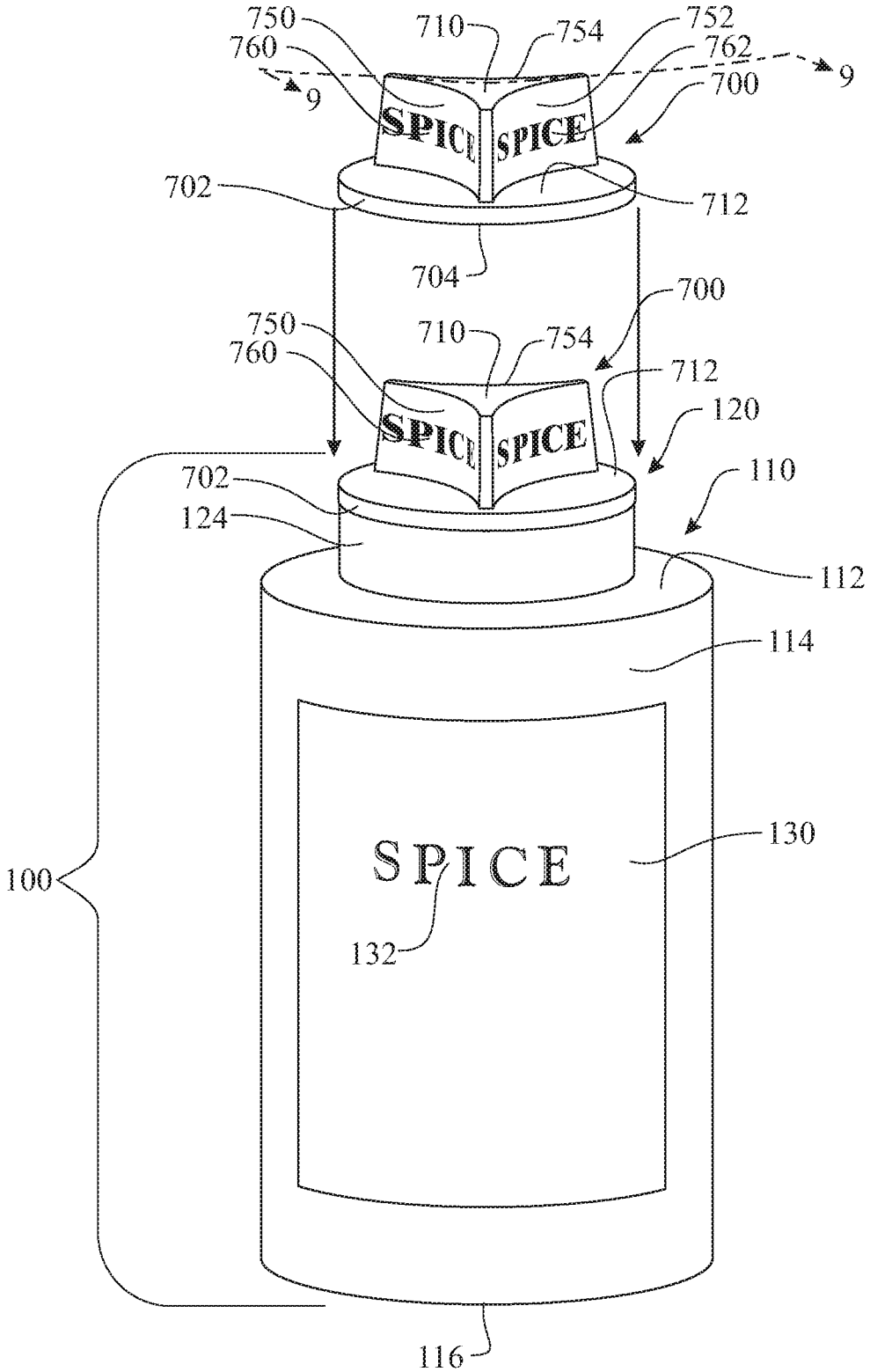
FIG. 8 presents an isometric view of a fifth exemplary bottle content identification assembly being attached to an exemplary cap of an exemplary bottle, wherein the fifth exemplary bottle content identification assembly is fabricated in a molded form factor.

A spice identifier billboard assembly 700, shown in FIG. 8, introduces a molded variant of the bottle identification system. The spice identifier billboard assembly 700 includes a spice identifier tab billboard 710 having a plurality of billboard surfaces 750, 752, 754. The exemplary embodiment includes three billboard surfaces, a first contents identification surface 750, a second contents identification surface 752, and a third contents identification surface 754. A first spice identifier indicia 760 is displayed upon the first contents identification surface 750; a second spice identifier indicia 762 is displayed upon the second contents identification surface 752; and a third spice identifier indicia (not shown), would be displayed upon the third contents identification surface 754. The spice identifier tab billboard 710 would extend upward from a spice identifier tab base element upper surface 712 of a spice identifier billboard supporting base element 702. An adhesive would be applied to a base element attachment surface 704 of the spice identifier billboard supporting base element 702. The base element attachment surface 704 would be bonded to the bottle cap top surface 122 of the bottle cap 120 using the adhesive. The adhesive would be protected prior to use by a removable covering. In use the removable covering would be removed and the base element attachment surface 704 would be aligned to a center of the bottle cap top surface 122. It is understood that other assembly configurations and methods can be employed to join the spice identifier billboard assembly 700 to the bottle cap 120. In one alternative, a magnet can be used to attach the base element attachment surface 704 to the bottle cap top surface 122 of a bottle cap 120 fabricated of a ferrous or other magnetically attracting material. In another alternative, a dense hook and loop tape can be used to attach the base element attachment surface 704 to the bottle cap top surface 122 of the bottle cap 120. Other assembly elements can include a mechanical assembly design, a wedge design, and the like.

Figure 9:
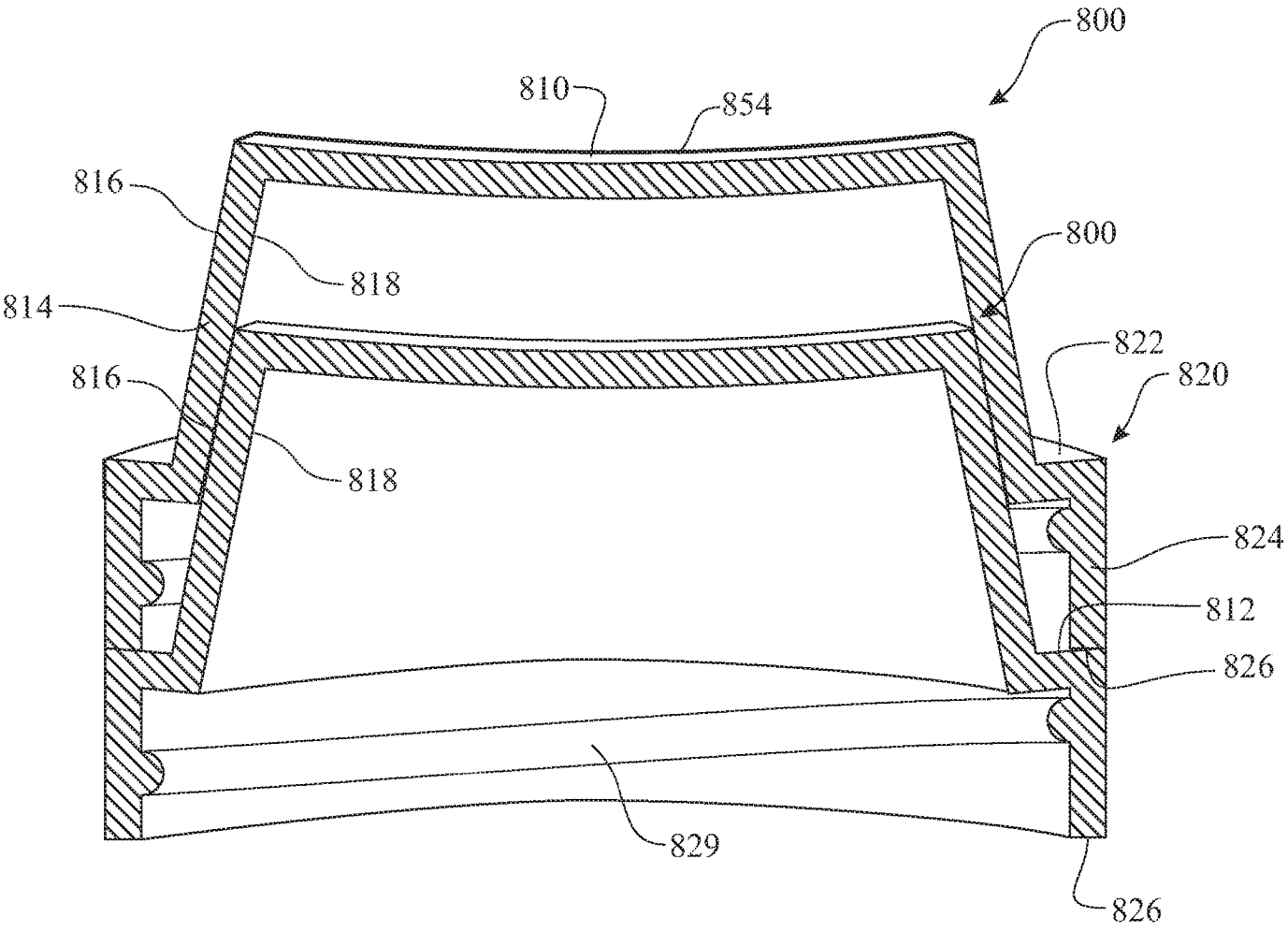
FIG. 9 presents a sectioned isometric view of modified version of the fifth exemplary bottle content identification system originally introduced in FIG. 8, the section being taken along section line 9-9 of FIG. 8, the modified version integrating a spice identifier tab billboard and a bottle cap.

In an alternative configuration, the spice identifier tab billboard 710 can be integrated directly to the bottle cap 120, such as the spice identifier billboard assembly 800 introduced in FIG. 9. In either configuration, the spice identifier tab billboard 710 is preferably hollowed and tapered, enabling nesting between a series of spice identifier tab billboards 710. This would enable stacking of the spice identifier tab billboards 710 for packaging, shipping, storage, and the like. A series of spice identifier billboard assemblies 700 can be offered as a set comprising a series of spice identifier tab billboards 710, each spice identifier tab billboard 710 having a distinct spice identifier indicia 760, 762, 764 applied to the associated billboard surfaces 750, 752, 754. The series of spice identifier billboard assemblies 700 would be offered for application to spice bottles spice bottle assembly 100 used by a chef, a homeowner, or other user.

Each billboard surface 750, 752, 754 is preferably shaped having an inwardly arched or concave surface, as illustrated. Alternatively, each of the billboard surfaces 750, 752, 754 can be shaped having a flat or planar surface. The inwardly arched shaped surfaces 750, 752, 754 provide an advantage to a user, wherein the inwardly arched shaped surfaces 750, 752, 754 can be an aid for opening and removing the bottle cap 120 from the bottle 110. Bottle caps 120 can be tightened when sealed against the bottle 110. A grip of a user can slip against the round surface of the bottle cap sidewall 124 when trying to twist the bottle cap 120 to open the spice bottle assembly 100. By introducing the inwardly arched shaped surfaces 750, 752, 754, the user is creating and applying a direct mechanical force to twist the bottle cap 120 to open the spice bottle assembly 100. The configuration of the spice identifier tab billboard 710 does not allow the user's grip to slip, thus transferring the force applied by the user directly to the bottle cap 120 to open the spice bottle assembly 100.

A spice identifier billboard assembly 800, shown in FIG. 9, introduces a variant of the fifth exemplary solution for enhancing labeling of the spice bottle assembly 100. The spice identifier billboard assembly 800 and the spice identifier billboard assembly 700 have a number of like elements. Like features of the spice identifier billboard assembly 800 and the spice identifier billboard assembly 700 are numbered the same except preceded by the numeral '8'. The illustration is a sectioned view taken along section 9-9 of FIG. 8.

A bottle cap portion 820 of the spice identifier billboard assembly 800 and the bottle cap 120 have a number of like elements. Like features of the bottle cap portion 820 of the spice identifier billboard assembly 800 and the bottle cap 120 are numbered the same except preceded by the numeral '8'.

The illustration details a nesting capability between stacked spice identifier billboard assemblies 800. The spice identifier tab billboard 810 includes at least three spice identifier billboard vertical wall segments 814, which are tapered or angled from a vertical direction. The tapered or angled configuration of the spice identifier billboard vertical wall segment 814 enables a spice identifier billboard exterior surface 816 of an inner or lower spice identifier billboard assembly 800 to slideably engage with a spice identifier billboard interior surface 818 of an outer or upper spice identifier billboard assembly 800, as shown. The exemplary spice identifier billboard assembly 800 illustrates a version integrating the spice identifier tab billboard 810 and the bottle cap portion 820 into a single unitary cap assembly. The bottle cap portion 820 includes an upper portion having a bottle cap top panel 822 defining an upper surface of the cap and a cylindrically shaped bottle cap sidewall 824 extending axially downward from a peripheral edge of the bottle cap top panel 822. The bottle cap sidewall 824 would terminate at a bottle cap bottom surface 826. The spice identifier billboard assembly 800 would be designed enabling maximum nesting when the bottle cap top panel 822 of one spice identifier billboard assembly 800 contacts a bottle cap bottom surface 826 of an adjacent spice identifier billboard assembly 800, as illustrated. The bottle cap portion 820 would further include a bottle cap fastening feature 829 used for removably assembling the spice identifier billboard assembly 800 to the bottle 110. The bottle cap fastening feature 829 can be any suitable design, including a threaded assembly configuration (as shown), a twist and lock assembly configuration, and the like. The size and shape of the spice identifier tab billboard 810 as well as the location inward of an edge of the bottle cap top panel 822 provides a clearance for the bottle cap fastening feature 829 when nesting two or more spice identifier billboard assemblies 800, as shown in the exemplary illustration presented in FIG. 9.

Figure 10:
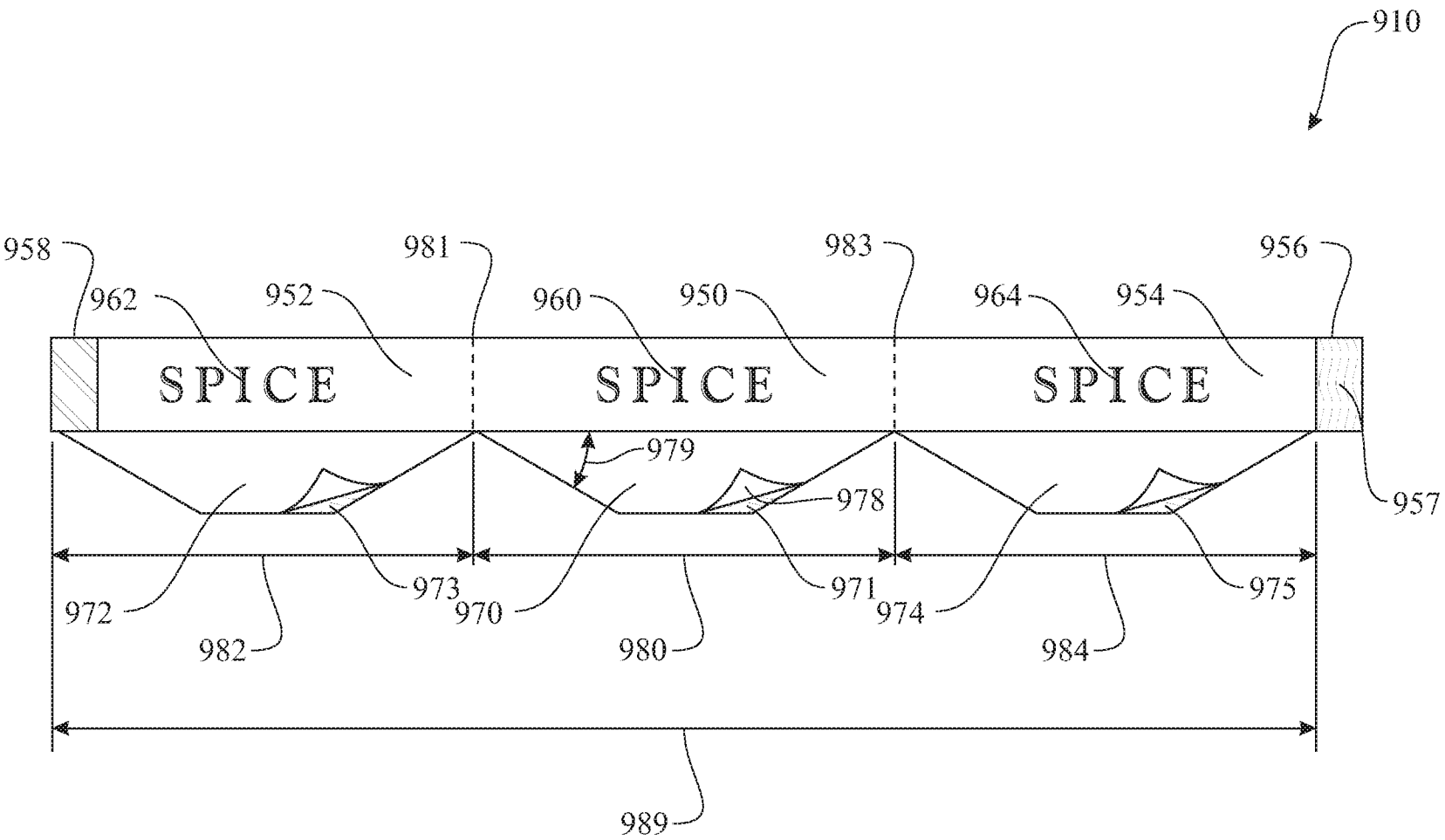
FIG. 10 presents a top plan view of a sixth exemplary bottle content identification system, wherein the sixth exemplary bottle content identification system provides a viewing solution similar to the fourth exemplary solution of FIG. 5.
Figure 11:
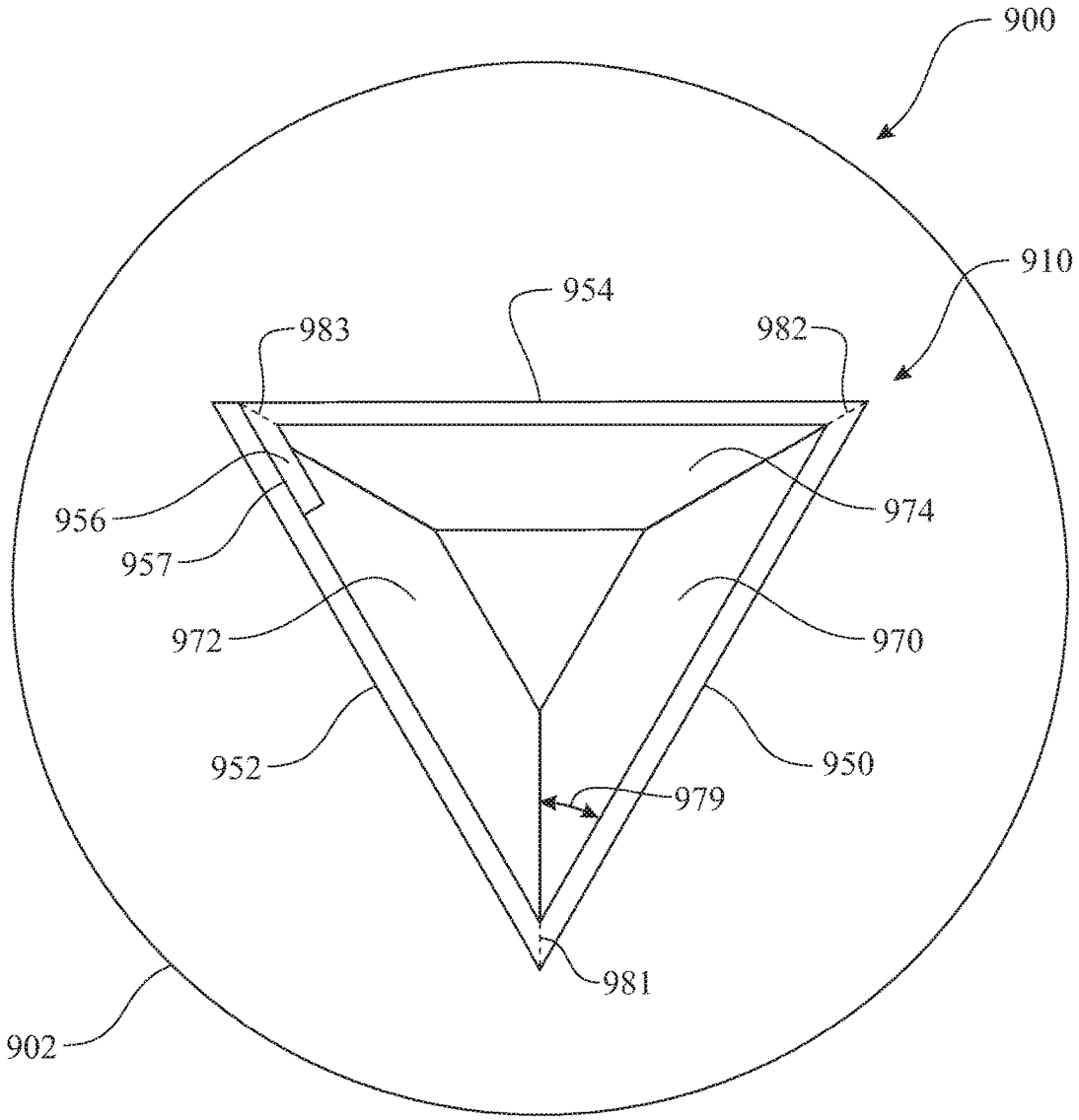
FIG. 11 presents a top plan view of the sixth exemplary bottle content identification system introduced in FIG. 10, wherein the sixth exemplary bottle content identification system is shown in a deployed configuration.
Figure 12:
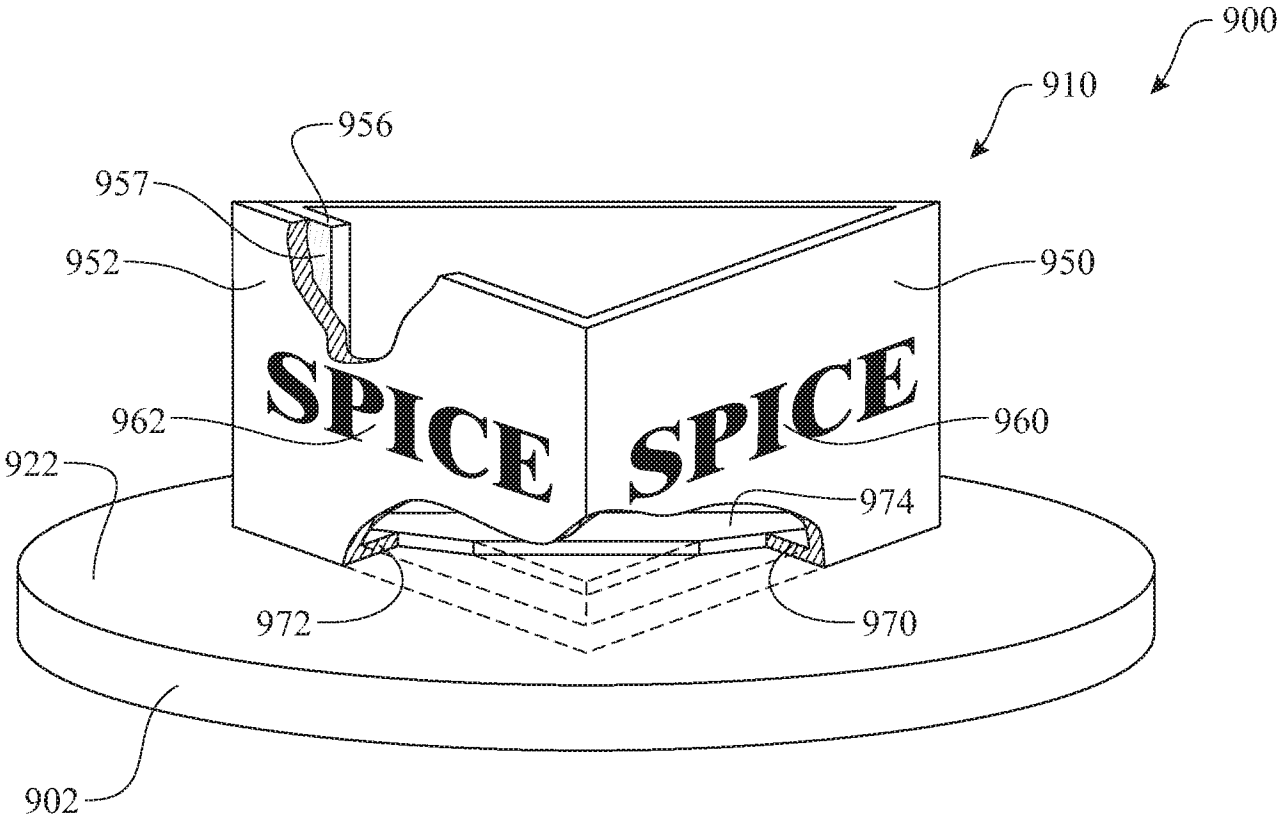
FIG. 12 presents a partially sections isometric view of the sixth exemplary bottle content identification system introduced in FIG. 10, wherein the sixth exemplary bottle content identification system is shown in a deployed configuration and details various assembly features.

A tri-fold spice identifier billboard assembly 900, shown in FIGS. 10 through 12, introduces a variant of the spice identifier tab assembly 500 for enhancing labeling of the spice bottle assembly 100. The tri-fold spice identifier billboard assembly 900 and the spice identifier tab assembly 500 have a number of like elements. Like features of the tri-fold spice identifier billboard assembly 900 and the spice identifier tab assembly 500 are numbered the same except preceded by the numeral '9'. It is noted that there are some distinctions between the tri-fold spice identifier billboard assembly 900 and the spice identifier tab assembly 500, which are detailed herein.

The tri-fold spice identifier billboard assembly 900 includes a spice identifier tab billboard 910 carried by a tri-fold spice identifier billboard substrate 902. Alternatively, the spice identifier tab billboard 910 can be directly assembled to the bottle cap top surface 122 of the bottle cap 120. The spice identifier tab billboard 910 includes a base planar material segmented into at least, and preferably three billboard segments 950, 952, 954. The base material can be fabricated of a paper, a heavy weight paper, a cardboard, a plastic, a thin metal, or any other suitable material. The base material can be fabricated of a plurality of materials laminated together enabling a desired folding capability. The base material is referenced as having a viewing surface and an opposite surface. Each segment 950, 952, 954 comprising spice identifier indicia 960, 962, 964 applied to the viewing surface of the base material, wherein the designed to identify contents of the respective spice bottle assembly 100. The base material would be shaped to include the at least three billboard segments 950, 952, 954 and a matching number of billboard attachment surfaces 970, 972, 974. A billboard segment fold 981, 983 is formed between each pair of adjacently located billboard segments 950, 952, 954. A first billboard bonding section 956 carrying a first billboard bonding section adhesive 957 is located extending outward from a distal end of the third contents identification segment 954. The first billboard bonding section adhesive 957 is preferably located on the viewing surface of the base material. A second billboard bonding section 958 is located inward from a distal end of the second contents identification segment 952. In an alternate embodiment, the first billboard bonding section adhesive 957 can be carried by the second billboard bonding section 958. In this instance, the first billboard bonding section adhesive 957 would preferably be located on an opposite side of the base material. The first billboard bonding section adhesive 957 would be covered by a protective cover (similar to the billboard attachment surface adhesive protective cover 978) until use.

The billboard segments 950, 952, 954 are preferably of a same length 980, 982, 984. Having the same billboard segment length 980, 982, 984 creates a symmetrically shaped tri-fold spice identifier billboard assembly 900 when assembled and attached to the bottle cap 120. Each billboard segment length 980, 982, 984 would be determined by dividing a billboard substrate length 989 of the base material by the number of segments.

The billboard attachment surfaces 970, 972, 974 are preferably shaped to avoid overlap of adjacent billboard attachment surfaces 970, 972, 974 when formed and assembled into a tri-fold spice identifier billboard substrate 902. In the exemplary embodiment, the billboard attachment surfaces 970, 972, 974 are shaped having a trapezoidal shape, more specifically an isosceles trapezoid shape. Two edges are parallel to the elongated direction of the base substrate and each end edge is shaped having a 30 degree angle (billboard attachment surface transverse edge angle 979) from the folding edge located between the billboard segments 950, 952, 954 and each respective billboard attachment surface 970, 972, 974.

Each billboard attachment surface 970, 972, 974 carries a billboard attachment surface adhesive 971, 973, 975. The billboard attachment surface adhesive 971, 973, 975 would be applied to the viewing side of the base material. The billboard attachment surface adhesive 971, 973, 975 is covered by a billboard attachment surface adhesive protective cover 978 until use.

The exemplary spice identifier tab billboard 910 is folded along each of the billboard segment folds 981, 983 forming an equilateral triangular shape, as best shown in FIG. 11. The first billboard bonding section 956 is folded inward as shown in FIG. 11. The first billboard bonding section adhesive 957 is bonded to an interior surface of the second billboard bonding section 958. Each billboard attachment surface 970, 972, 974 is folded inward defining a planar attachment surface. The billboard attachment surface adhesive protective covers 978 are removed from each respective billboard attachment surface 970, 972, 974, exposing the billboard attachment surface adhesive 971, 973, 975. The billboard attachment surface adhesive 971, 973, 975 is used to bond the spice identifier tab billboard 910 to a tri-fold spice identifier billboard substrate 902 or directly the bottle cap top surface 122 of the bottle cap 120. When using the tri-fold spice identifier billboard substrate 902, the tri-fold spice identifier billboard substrate 902 would then be joined to the bottle cap 120 using any suitable assembly method.

Similar to the previous variants, the spice identifier tab billboard 910 can be provided in a kit format, the kit comprising a plurality of spice identifier tab billboards 910, each spice identifier tab billboard 910 having a unique spice identifier indicia 960, 962, 964. The series of spice identifier indicia 960, 962, 964 would include a description of commonly used spices or other commonly used ingredients stored in containers, such as the bottle 110.

A series of spice identifier tab assemblies 200, 300, 400, 500, 600, 700, 800, 900 can be provided, wherein each of the spice identifier tab assemblies 200, 300, 400, 500, 600, 700, 800, 900 would include an identifier associated with a unique spice or other content. The identifiers can be provided as a series of labels, wherein the user would apply the label with indicia identifying the desired spice or other content onto the respective spice identifier tab assembly 200, 300, 400, 500, 600, 700, 800, 900. In another solution, the user can simply applied the indicia using a permanent marker.

It is also noted that the various identifiers 200, 300, 400, 500, 600, 700, 800, 900 can be color coded to provided additional distinguishing features for easier identification of the desired bottle.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

ELEMENT DESCRIPTION REFERENCES

Ref No. Description

100 spice bottle assembly
110 bottle
112 bottle top surface
114 bottle sidewall
116 bottle bottom wall
120 bottle cap
122 bottle cap top surface
124 bottle cap sidewall
126 bottle cap bottom wall
130 bottle label
132 spice identifier indicia
200 spice identifier loop
210 spice identifier loop exterior surface
212 spice identifier loop interior surface
220 spice identifier indicia
300 spice identifier tab assembly
302 spice identifier tab substrate
304 substrate adhesive surface
310 spice identifier tab billboard
312 spice identifier tab billboard base segment
314 spice identifier tab billboard fold crease
320 spice identifier indicia
330 spice identifier tab billboard support leg
332 billboard support leg attachment tab
334 billboard support leg fold crease
339 support leg rotational motion
400 spice identifier label
410 spice identifier label substrate
420 spice identifier indicia
412 label adhesive surface
500 spice identifier tab assembly
502 spice identifier tab substrate
506 spice identifier tab substrate circumferential edge
510 spice identifier tab billboard
512 spice identifier tab billboard base segment
520 spice identifier indicia
530 spice identifier tab billboard support leg
532 billboard support leg attachment tab
539 support leg rotational motion
550 contents identification wrap
552 contents identification wrap circumferential length
554 first bonding section
556 second bonding section
559 optional contents identification wrap separation feature
560 centrally located indicia
562 distally located indicia
600 spice identifier tab assembly
602 spice identifier tab substrate
606 spice identifier tab substrate circumferential edge
610 spice identifier tab billboard
612 spice identifier tab billboard base segment
620 spice identifier indicia
630 spice identifier tab billboard support leg
632 billboard support leg attachment tab
639 support leg rotational motion
650 contents identification wrap
652 contents identification wrap circumferential length
654 first bonding section
656 second bonding section
659 optional contents identification wrap separation feature
660 centrally located indicia
662 distally located indicia
700 spice identifier billboard assembly
702 spice identifier billboard supporting base element
704 base element attachment surface
710 spice identifier tab billboard
712 spice identifier tab base element upper surface
714 spice identifier billboard exterior surface
716 spice identifier billboard interior surface
750 first contents identification surface
752 second contents identification surface
754 third contents identification surface
760 first spice identifier indicia
762 second spice identifier indicia

800 spice identifier billboard assembly
810 spice identifier tab billboard
814 spice identifier billboard vertical wall segment
816 spice identifier billboard exterior surface
818 spice identifier billboard interior surface
820 bottle cap portion
822 bottle cap top panel
824 bottle cap sidewall
826 bottle cap bottom surface
829 bottle cap fastening feature
854 third contents identification surface
900 tri-fold spice identifier billboard assembly
902 tri-fold spice identifier billboard substrate
910 spice identifier tab billboard
922 tri-fold spice identifier billboard substrate top surface
950 first contents identification segment
952 second contents identification segment
954 third contents identification segment
956 first billboard bonding section
957 first billboard bonding section adhesive
958 second billboard bonding section
960 first spice identifier indicia
962 second spice identifier indicia
964 first spice identifier indicia
970 first billboard attachment surface
971 first billboard attachment surface adhesive
972 second billboard attachment surface
973 second billboard attachment surface adhesive
974 third billboard attachment surface
975 third billboard attachment surface adhesive
978 billboard attachment surface adhesive protective cover
979 billboard attachment surface transverse edge angle
980 first billboard segment length
981 first billboard segment fold
982 second billboard segment length
983 second billboard segment fold
984 third billboard segment length
989 billboard substrate length

What is claimed is:

1. A method of identifying contents of a bottle, the method comprising steps of:

obtaining a bottle having contents therein, the bottle comprising:

a container, the container defining an interior volume for storing contents, and a bottle cap removably attachable to the container in a manner to seal the container when closed and obtain access to contents within the interior volume of the container when removed;

identifying contents within the interior volume of the container;

obtaining a contents identifier assembly, the contents identifier assembly comprising:

(a) a billboard supporting base element, (b) a contents identifier billboard assembly having at least three contents identification surfaces, each contents identification surface generally extending in an axial direction from the billboard supporting base element, (c) a contents identifier indicia displayed upon each of the at least three contents identification surfaces, the contents identifier indicia being representative of contents within the interior volume of the container; and joining the contents identifier assembly to the container in a manner wherein the indicia is visible from a side elevation view of the bottle, the step being completed by one of:

(a) affixing the billboard supporting base element to a top surface of a bottle cap and assembling the bottle cap to the container, or (b) the billboard supporting base element being an integral element of the bottle cap and assembling the bottle cap to the container, the contents identifier billboard assembly includes a hollowed interior cavity, enabling a nesting arrangement between multiple contents identifier billboard assemblies.

2. A method of identifying contents of a bottle as recited in claim 1, wherein the step of affixing the billboard supporting base element to the top surface of the bottle cap is accomplished using at least one of an adhesive, a bonding agent, and a magnet.

3. A method of identifying contents of a bottle as recited in claim 1, wherein the contents identifier billboard assembly includes the hollowed interior cavity, the method further comprising the step of:

storing multiple contents identifier billboard assemblies in the nested arrangement.

4. A method of identifying contents of a bottle as recited in claim 1, further comprising a step of:

obtaining a series of contents identifier billboard assemblies, each contents identifier billboard assembly of the series of contents identifier billboard assemblies having a different contents identifier indicia displayed thereon from the other contents identifier indicia of the other contents identifier billboard assembly.

5. A method of identifying contents of a bottle as recited in claim 1, further comprising a step of:

identifying a spice, wherein the contents identifier indicia is representative of the spice contained within the interior volume of the container.

6. A method of identifying contents of a bottle as recited in claim 1, the method further comprising a step of:

aiding a user in rotating the bottle cap about the container by applying a force to the contents identification surface of the contents identifier assembly.

7. A method of identifying contents of a bottle as recited in claim 1, each contents identification surface having an inwardly arched surface, the method further comprising a step of:

aiding a user in rotating the bottle cap about the container by applying a force to the contents identification surface of the contents identifier assembly.

8. A method of identifying contents of a bottle, the method comprising steps of:

obtaining a bottle having contents therein, the bottle comprising:

a container, the container defining an interior volume for storing contents, and a bottle cap removably attachable to the container in a manner to seal the container when closed and obtain access to contents within the interior volume of the container when removed;

identifying contents within the interior volume of the container;

obtaining at least one contents identifier assembly, each of the at least one contents identifier assembly comprising:

(a) a billboard supporting base element, (b) a contents identifier billboard assembly having at least three contents identification surfaces, each contents identification surface generally extending in an axial direction from the billboard supporting base element, (c) a contents identifier indicia displayed upon each of the at least three contents identification surfaces, the contents identifier indicia being representative of contents within the interior volume of the container; and joining the contents identifier assembly to the container in a manner wherein the indicia is visible from a side elevation view of the bottle, the step being completed by affixing the billboard supporting base element to a top surface of a bottle cap and assembling the bottle cap to the container, and further comprising at least one of the following steps:

1) storing multiples of the at least one contents identifier assembly in a nested arrangement, wherein each contents identifier assembly of the at least one contents identifier assembly further comprising a hollowed interior cavity, 2) obtaining a series of contents identifier assemblies, each contents identifier billboard assembly of the series of contents identifier assemblies having a different contents identifier indicia displayed thereon from the other contents identifier indicia of the other contents identifier assemblies of the series of contents identifier billboard assemblies, 3) aiding a user in rotating the bottle cap about the container by applying a force to the contents identification surface of the respective at least one contents identifier assembly attached to the bottle cap, and 4) aiding a user in rotating the bottle cap about the container by applying a force to the contents identification surface of the contents identifier assembly, wherein each contents identification surface is formed having an inwardly arched surface.

9. A method of identifying contents of a bottle as recited in claim 8, wherein the step of affixing the billboard supporting base element to the top surface of the bottle cap is accomplished using at least one of an adhesive, a bonding agent, and a magnet.

10. A method of identifying contents of a bottle as recited in claim 8, wherein the at least one contents identifier assembly includes a hollowed interior cavity, the method further comprising a step of:

storing multiples of the at least one contents identifier assembly in a nested arrangement.

11. A method of identifying contents of a bottle as recited in claim 8, further comprising a step of:

obtaining the series of contents identifier assemblies, each contents identifier assembly of the series of contents identifier assemblies having a different contents identifier indicia displayed thereon from the other contents identifier indicia of the other contents identifier assemblies of the series of contents identifier assemblies.

12. A method of identifying contents of a bottle as recited in claim 8 wherein the contents are a spice, the method further comprising a step of:

identifying the spice, wherein the contents identifier indicia is representative of the spice contained within the interior volume of the container.

13. A method of identifying contents of a bottle as recited in claim 8, the method further comprising a step of:

aiding a user in rotating the bottle cap about the container by applying a force to the respective at least one contents identification surface of the contents identifier assembly attached to the bottle cap.

14. A method of identifying contents of a bottle as recited in claim 8, each contents identification surface having an inwardly arched surface, the method further comprising a step of:

aiding a user in rotating the bottle cap about the container by applying a force to the respective at least one contents identification surface of the contents identifier assembly attached to the bottle cap.

15. A method of identifying contents of a bottle, the method comprising steps of:

obtaining a bottle having contents therein, the bottle comprising:

a container, the container defining an interior volume for storing contents, and a bottle cap removably attachable to the container in a manner to seal the container when closed and obtain access to contents within the interior volume of the container when removed;

identifying contents within the interior volume of the container;

obtaining a contents identifier assembly, the contents identifier assembly comprising:

(a) a contents identifier billboard assembly having at least three contents identification surfaces, each contents identification surface generally extending in an axial direction from the billboard supporting base element, (b) a contents identifier indicia displayed upon each of the at least three contents identification surfaces, the contents identifier indicia being representative of contents within the interior volume of the container;

(c) the contents identifier billboard assembly includes a hollowed interior cavity;

storing multiple contents identifier billboard assemblies in a nested arrangement; and joining the contents identifier assembly to the container in a manner wherein the indicia is visible from a side elevation view of the bottle, the step being completed by assembling the bottle cap to the container.

16. A method of identifying contents of a bottle as recited in claim 15, wherein the contents identifier billboard assembly is integral with the bottle cap.

17. A method of identifying contents of a bottle as recited in claim 15, further comprising a step of:

obtaining a series of contents identifier billboard assemblies, each contents identifier billboard assembly of the series of contents identifier billboard assemblies having a different contents identifier indicia displayed thereon from the other contents identifier indicia of the other contents identifier billboard assembly.

18. A method of identifying contents of a bottle as recited in claim 15, further comprising a step of:

identifying a spice, wherein the contents identifier indicia is representative of the spice contained within the interior volume of the container.

19. A method of identifying contents of a bottle as recited in claim 15, the method further comprising a step of:

aiding a user in rotating the bottle cap about the container by applying a force to the contents identification surface of the contents identifier assembly.

20. A method of identifying contents of a bottle as recited in claim 15, each contents identification surface having an inwardly arched surface, the method further comprising a step of:

aiding a user in rotating the bottle cap about the container by applying a force to the contents identification surface of the contents identifier assembly.

* * * * *